US008869693B2

(12) United States Patent
Niswonger

(10) Patent No.: US 8,869,693 B2
(45) **Date of Patent: *Oct. 28, 2014**

(54) LOCKING STRIP PANEL FOR SILKSCREEN FRAME

(71) Applicant: John O. H. Niswonger, Calabasas, CA (US)

(72) Inventor: John O. H. Niswonger, Calabasas, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/016,231

(22) Filed: Sep. 3, 2013

(65) Prior Publication Data

US 2014/0000466 A1 Jan. 2, 2014

Related U.S. Application Data

(63) Continuation of application No. 13/550,852, filed on Jul. 17, 2012, now Pat. No. 8,522,681, which is a continuation of application No. 12/409,522, filed on Mar. 24, 2009, now Pat. No. 8,220,387, which is a continuation-in-part of application No. 11/827,729, filed on Jul. 13, 2007, now Pat. No. 7,752,963.

(60) Provisional application No. 60/830,712, filed on Jul. 13, 2006, provisional application No. 61/070,702, filed on Mar. 24, 2008, provisional application No. 61/130,362, filed on May 31, 2008.

(51) Int. Cl.
*B05C 17/06* (2006.01)
*B41F 15/36* (2006.01)

(52) U.S. Cl.
CPC ..... *B41F 15/36* (2013.01)
USPC ..... 101/127.1; 160/328; 160/368.1; 38/102.1

(58) Field of Classification Search
CPC ..... B41F 15/34; B41F 15/36; H05K 3/1216; H05K 3/1225
USPC ..... 101/114, 127, 127.1, 129; 38/102.1–102.91; 160/327–330, 368.1
See application file for complete search history.

(56) References Cited

U.S. PATENT DOCUMENTS

| | | | | |
|---|---|---|---|---|
| 4,249,589 | A * | 2/1981 | Loeb | 160/368.1 |
| 4,462,174 | A * | 7/1984 | Messerschmitt | 38/102.1 |
| 5,113,611 | A * | 5/1992 | Rosson | 38/102.7 |
| 5,911,266 | A * | 6/1999 | Jacobs | 160/368.1 |
| 2003/0075258 | A1 * | 4/2003 | Zhang et al. | 156/93 |
| 2005/0196585 | A1 * | 9/2005 | Yu | 428/102 |
| 2009/0145559 | A1 * | 6/2009 | Glasl et al. | 160/273.1 |

* cited by examiner

*Primary Examiner* — Ren Yan
(74) *Attorney, Agent, or Firm* — Ronald L. Rohde

(57) ABSTRACT

A panel for tensioning fabric such as a silkscreen mesh is described. The panel includes locking strips secured to the edges using stitching through the mesh and locking strips. A method for fabricating the panel and tensioning the panel on a frame is also described. Locking strips may be stitched to edges of the fabric or mesh.

20 Claims, 15 Drawing Sheets

LOCKING STRIP PANEL FOR SILKSCREEN FRAME

CROSS-REFERENCE TO RELATED APPLICATIONS

The present application is a continuation of and claims priority and benefit to co-pending U.S. patent application Ser. No. 13/550,852, filed on Jul. 17, 2012 and titled "LOCKING STRIP PANEL FOR SILKSCREEN FRAME," which is a continuation of and claims priority and benefit to U.S. patent application Ser. No. 12/409,522, (now U.S. Pat. No. 8,220,287) filed on Mar. 24, 2009 and titled "PIVOTING LOCKING STRIP SYSTEM AND APPARATUS FOR SILKSCREEN FRAME," which claims priority and benefit to U.S. Provisional Patent Application Ser. No. 61/070,702 filed on Mar. 24, 2008 titled "Pivoting Locking Strip System and Apparatus for Silkscreen Frame," and to U.S. Provisional Patent Application Ser. No. 61/130,362, filed on May 31, 2008 and titled "Panel and Mesh for Pivoting Locking Strip and Silkscreen System;" U.S. patent application Ser. No. 12/409,522, is also a continuation in part and claims priority and benefit to U.S. patent application Ser. No. 11/827,729, (now U.S. Pat. No. 7,752,963) filed on Jul. 13, 2007 and titled "Apparatus and Method for Screen Tensioning," which claims priority and benefit to U.S. Provisional Patent Application Ser. No. 60/830,712, filed on Jul. 13, 2006 and titled "Improved Apparatus and Method for Screen Tensioning." All of the above applications are incorporated by reference herein in their entirety.

BACKGROUND

1. Field of the Application

The present application relates generally to a silkscreen apparatus, and more particularly to silkscreen fabric tensioning.

2. Description of Related Art

Generally, a screen tensioning and printing frame is capable of handling fabrics across the wide range of weight and texture. One method is to use a roller frame member including a longitudinal groove and a locking strip to secure the fabric into the groove. Another is to use a rectangular frame member including a longitudinal groove and a locking strip. The fabric is pushed into the groove. The locking strip is inserted into the groove from an end of the groove and pushed or pulled lengthwise through the groove to secure the fabric. The locking strip is extracted from the groove by sliding it the length of the groove out one end of the groove to release the fabric. Often the groove is the length of the roller. Another method is to glue the mesh to a frame. Frequently, solvents are used during the silk screen process that can degrade the bond, causing further failure. Special glues may be required to withstand the tension and/or effects of the solvents. An emulsion is to a surface of the mesh before gluing for use during the silkscreen process.

SUMMARY

Various embodiments of the technology include a frame for tensioning a mesh, the frame comprising an elongated frame member configured to use a locking strip to secure the mesh for tensioning and a groove disposed in an upper surface along a long axis of the elongated frame member and configured to receive and orient the locking strip for securing the mesh upon application of tension to the mesh. The groove comprises a groove entrance including a first groove edge and a second groove edge in the upper surface of the elongated frame member, a groove floor forming a central cavity between the groove entrance and the groove entrance, and an insertion cavity. The insertion cavity is adjacent the first groove edge and configured to receive insertion of a leading edge of the locking strip to a depth sufficient to provide clearance for rotation of a trailing edge of the locking strip past the second groove edge into the groove. The groove further comprises a side cavity opposite the central cavity. The side cavity includes a vertex, an upper vertex surface between the second groove edge and the vertex and a lower vertex surface between the vertex and the floor, the central cavity disposed between the insertion cavity and the side cavity.

Various embodiments of the technology include a locking strip groove for a screen tensioning the frame. The locking strip groove comprises a groove entrance disposed between a first groove edge and a second groove edge, a groove floor below the groove entrance forming a bottom of the groove, and an insertion cavity between a ceiling and a portion of the groove floor. The insertion cavity is configured to receive insertion of a leading edge of the locking strip. The locking strip groove further comprises a side cavity formed by an upper vertex surface adjacent to the second groove edge and a lower vertex surface between the upper vertex surface and the groove floor. The upper vertex surface and lower vertex surface intersect at an angle. The locking strip groove further comprises a central cavity above the floor and below the entrance. The central cavity is between the side cavity and the insertion cavity.

Various embodiments of a method for making a frame member comprises extruding the frame member including a groove. The groove includes a groove entrance, a central cavity between a groove floor and the groove entrance, and an insertion cavity coupled to the groove entrance and the floor. The insertion cavity is adjacent the central cavity. The groove further includes a side cavity opposite the central cavity from the insertion cavity and coupled to the groove entrance and the floor. The side cavity includes a vertex. The groove further includes a pivot disposed on the groove floor. The method further comprises removing a portion of the side cavity and vertex above the floor from an end of the frame member.

DETAILED DESCRIPTION

Figure 1A:
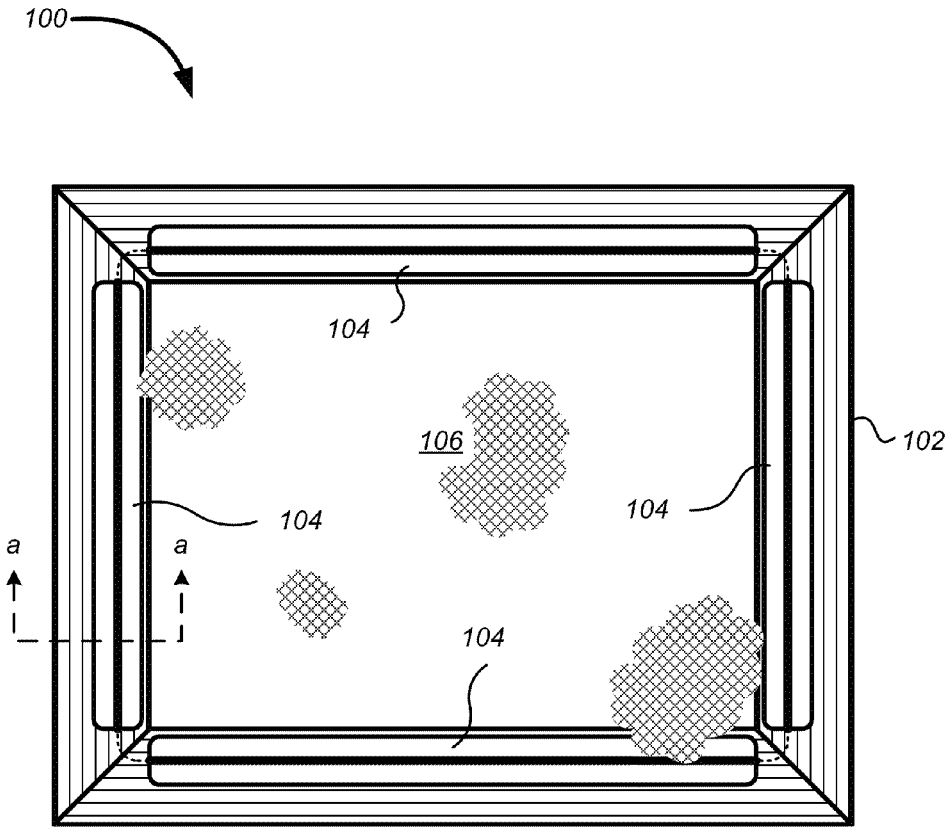
FIG. 1A is a top plan view of an embodiment of a screen tensioning and printing frame in accordance with aspects of the technology.

FIG. 1A is a top plan view of an embodiment of a screen tensioning and printing frame generally designated 100, in accordance with aspects of the technology. A screen fabric or mesh 106 may be applied to one face of the frame 100. The frame 100 includes a base 102 and a plurality of frame members designated 104. The frame members 104 may be about mutually perpendicular or parallel to each other. The screen fabric or mesh 106 may be suspended between the frame members 104. Edges of the mesh 106 may be secured to the frame members 104. The frame members 104 may be supported on and/or secured to the base 102. The base 102 may be configured to support the frame members 104 under tension for stretching the suspended mesh 106.

Figure 1B:
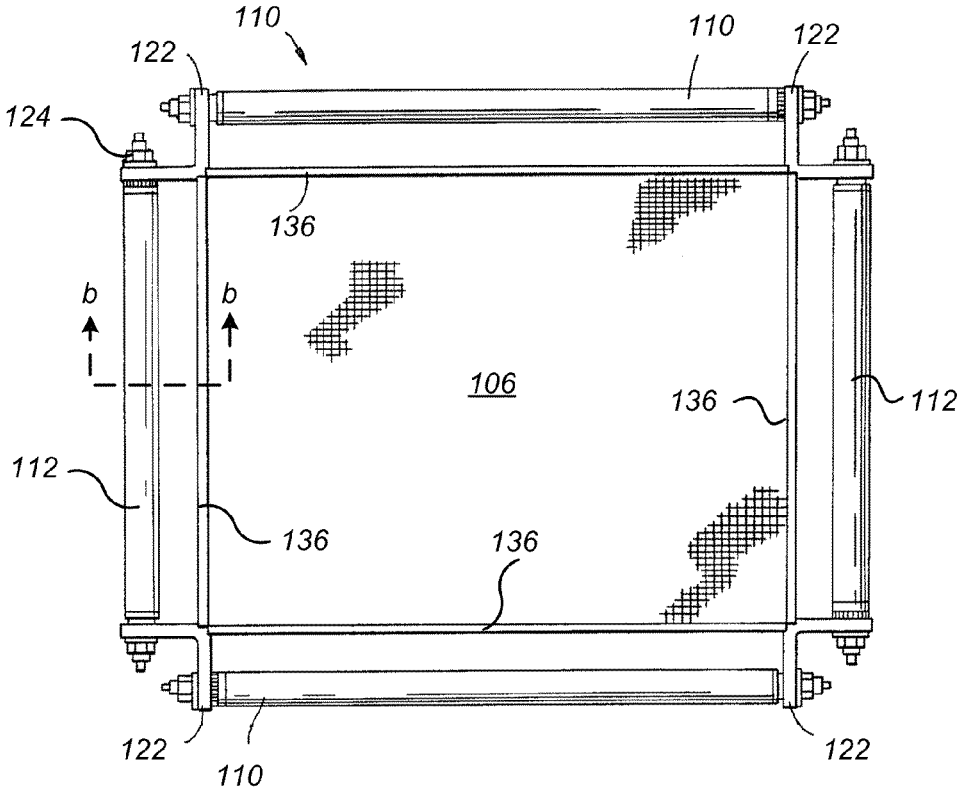
FIG. 1B is a top plan view of an embodiment of a screen tensioning and printing frame in accordance with aspects of the technology.

FIG. 1B is a top plan view of an embodiment of a screen tensioning and printing frame generally designated 110, in accordance with aspects of the technology. The mesh 106 may be applied to one face of the frame. The frame 110 includes a plurality of frame members designated 112 which may be about mutually perpendicular or parallel to each other. The frame members 112 may be rotatably supported at their respective ends by a plurality of corner members 122.

In some embodiments, the frame members 104 and/or 112 are hollow frame members made from a light weight, non-corrosive material such as aluminum, steel, plastic, and/or the like. The frame members 104 and/or 112 may be extruded and cut to a desired length. Hollow frame members may be sealed using plugs. In some embodiments, the frame members 104 and/or 112 are sealed using welds.

The plurality of corner members 122 are rigid members and may be made from a lightweight non-corrosive material such as aluminum, steel, plastic, and/or the like. The plurality of corner members 122 may be supported by a frame assembly 136. In some embodiments, one or more frame members 112 are secured in a predetermined rotative position so that a desired tension may be applied to a screen fabric or mesh 106. The tension may be applied to the mesh 106 by a rotation of one or more of the frame members 112. The frame members 112 may be rotated individually or in various combinations to apply tension to the mesh 106, as is well understood by persons skilled in the art.

In some embodiments, one or more frame members 104 may be secured in a predetermined translational position such that a desired tension may be applied to a mesh 106. The tension may be applied to the mesh 106 by a translation of the frame members 104 in about the plane of the frame 100. For example, the frame members 104 may be secured to the base 102. In some embodiments, a bottom surface of frame members 104 include a ratchet assembly. Similarly, a top surface of the base 102 may include a ratchet assembly that is complimentary and configured to engage the ratchet assembly on the bottom of the frame members 104. The ratchet/complimentary ratchet assemblies may be used to aid in applying tension to the mesh 106 and/or constrain the frame member 104 to a desired position on the base 102 in a manner well known by persons having ordinary skill in the art. The frame members 112 may be translated individually or in various combinations to apply tension to the mesh 106, as is well understood by persons having ordinary skill in the art.

Figure 2A:
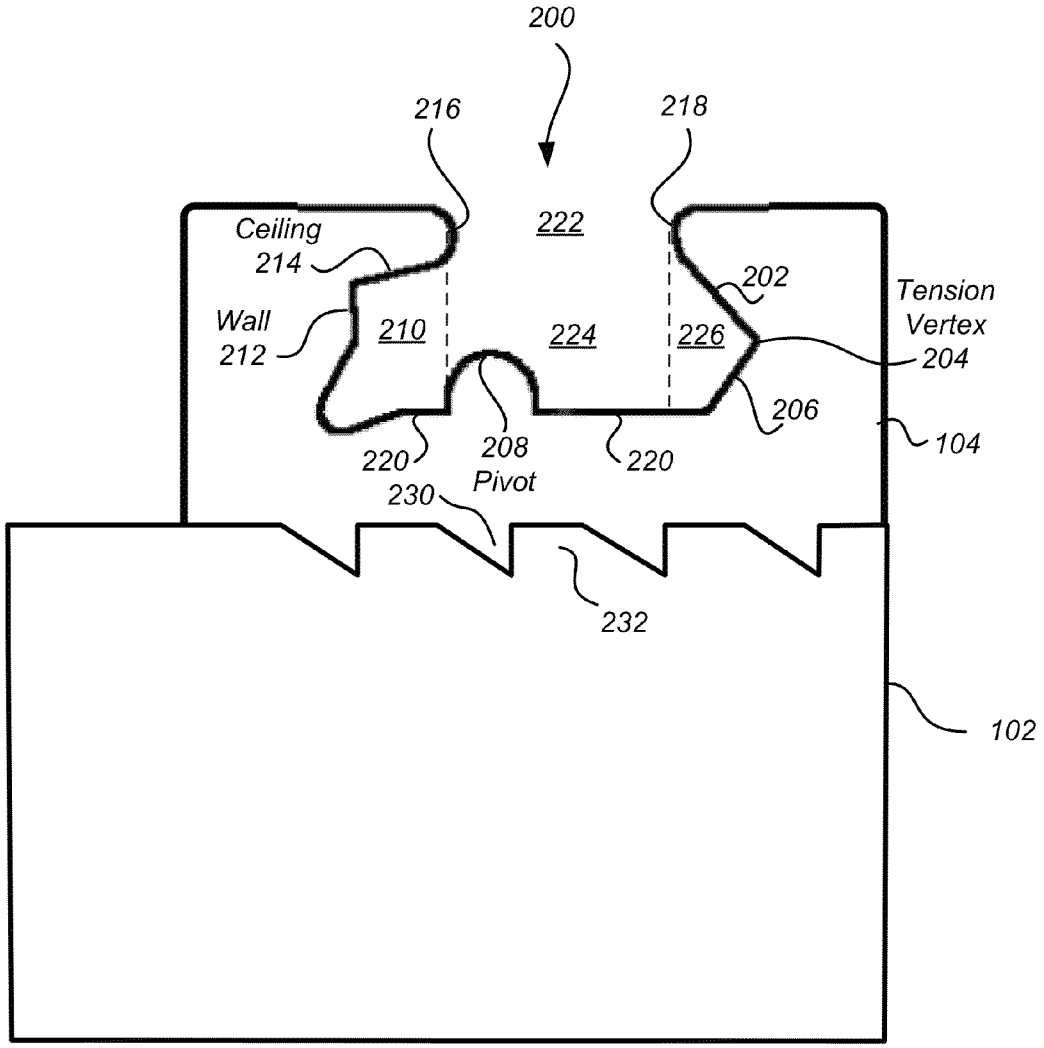
FIG. 2A is a cross section view taken along line a-a of FIG. 1A illustrating a silkscreen frame member and the base in accordance with various features of the technology.

FIG. 2A is a cross section view taken along line a-a of FIG. 1A illustrating the silkscreen frame member 104 and the base 102 in accordance with various features of the technology. The frame member 104 includes a locking strip groove 200 and an optional ratchet assembly 230 disposed on a bottom surface. The base member includes an optional ratchet assembly 232 disposed on the top surface. The locking strip groove 200 is defined by various surfaces and features including an upper vertex surface 202, a vertex 204, a lower vertex surface 206, floor 220, a pivot 208, a insertion cavity 210, a wall 212, a ceiling 214, a first edge 216, and a second edge 218. An entrance 222 is disposed between the first edge 216 and the second edge 218. Direction 2 is toward the center of the frame 100. Direction 1 is toward the outside of the frame 100. The cross section illustrated in FIG. 2A is rectangular. However, a person having ordinary skill in the art will recognize that the frame member 112 may have a cross section that is generally a triangle, a square, a rectangle, a polygon having five or more sides, or an irregular shape.

The upper vertex surface 202, the vertex 204 and the lower vertex surface 206 form a side cavity 226. The floor 220 and the entrance 222 form a central cavity 224 between the side cavity 226 and the insertion cavity 210. Dotted lines are used to indicate approximate regions for the insertion cavity 210, the central cavity 224, and the side cavity 226 and are not a part of the structure. The locking strip groove 200 may resemble an inverted T-slot. The entrance 222 and the central cavity 224 form a vertical portion of the T-slot while the insertion cavity 210 and the side cavity 226 complete a cross for the inverted T-slot.

Figure 2B:
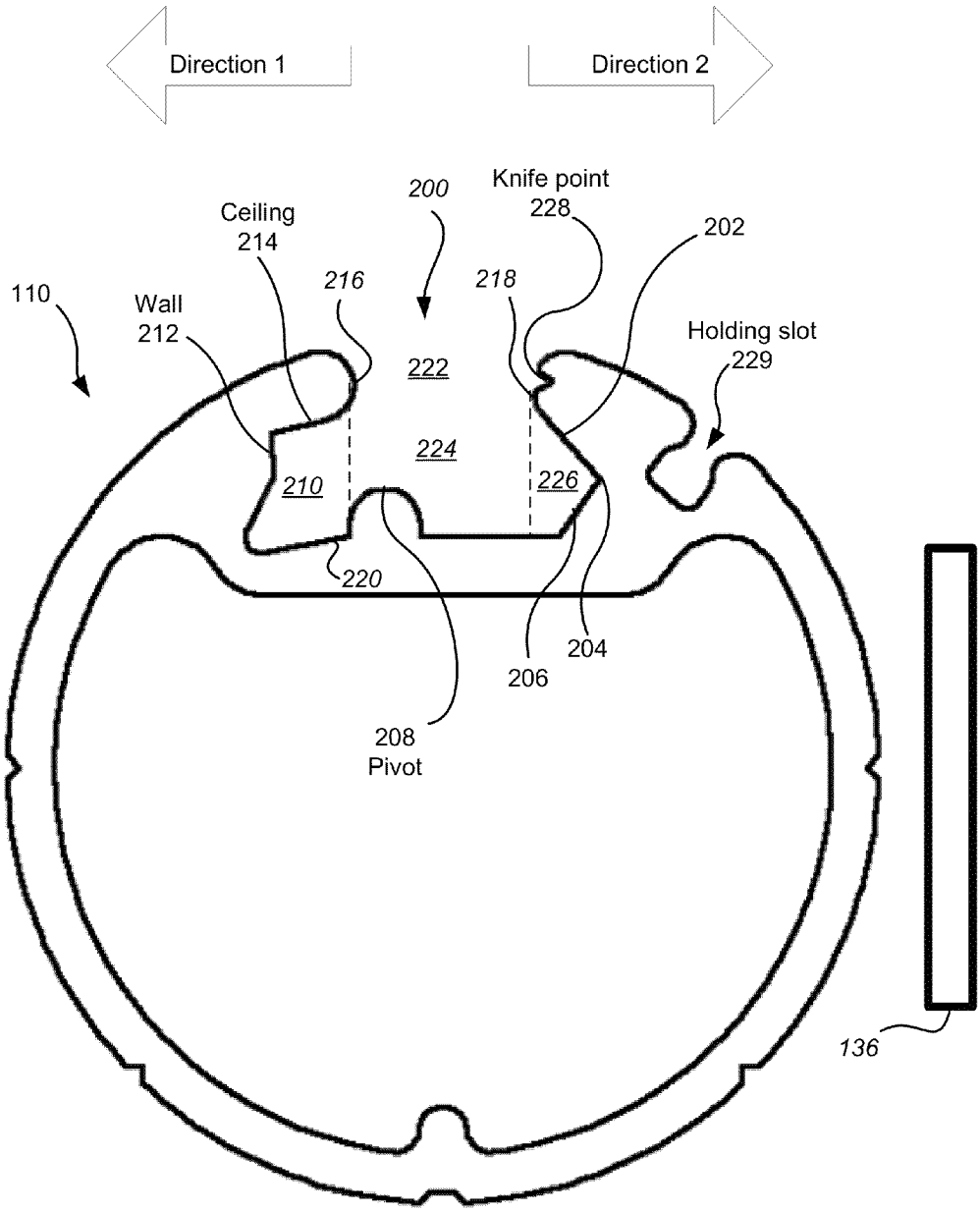
FIG. 2B is a cross section view taken along line b-b of FIG. 1B illustrating a silkscreen frame member in accordance with various features of the technology.

FIG. 2B is a cross section view taken along line b-b of FIG. 1B illustrating the silkscreen frame member 112 in accordance with various features of the technology. The frame member 112 includes a locking strip groove 200, an optional holding slot 229, and an optional knifepoint groove 228. The locking strip groove 200 of frame member 112 is similar to the locking strip groove 200 of frame member 104 and is defined by various surfaces and features including an upper vertex surface 202, a vertex 204, a lower vertex surface 206, floor 220, a pivot 208, a insertion cavity 210, a wall 212, a ceiling 214, a first edge 216, and a second edge 218. An entrance 222 is disposed between the first edge 216 and the second edge 218. Direction 2 is toward the center of the frame 110. Direction 1 is toward the outside of the frame 110. The cross section illustrated in FIG. 1A is circular. However, a person having ordinary skill in the art will recognize that the frame member 112 may have a cross section that is generally an oval shape, an oblong shape or an irregular shape. As in FIG. 2B, the upper vertex surface 202, the vertex 204 and the lower vertex surface 206 form a side cavity 226. The floor 220 and the entrance 222 form a central cavity 224 between the side cavity 226 and the insertion cavity 210.

Figure 3A:
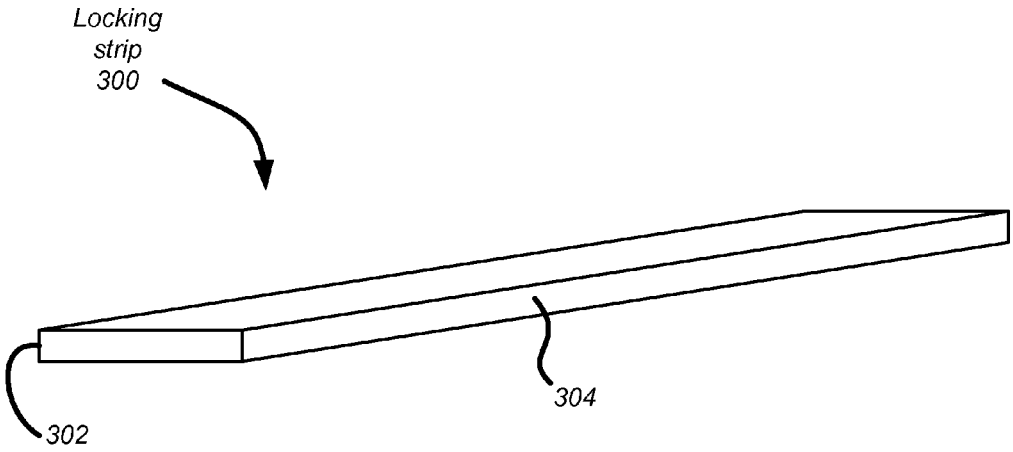
FIG. 3A is a front perspective view of a locking strip

FIG. 3A is a front perspective view of a locking strip 300. The locking strip 300 includes a leading edge 302 and a trailing edge 304. Generally, locking strips are symmetric and a designation of leading edge refers to an edge of the locking strip 300 that is inserted into the locking strip groove 200 before the trailing edge. In various embodiments, the locking strip is fabricated using semi-rigid, flexible materials including plastic, aluminum, fiber glass, rubber, and/or the like embodiments, plastic.

Figure 3B:
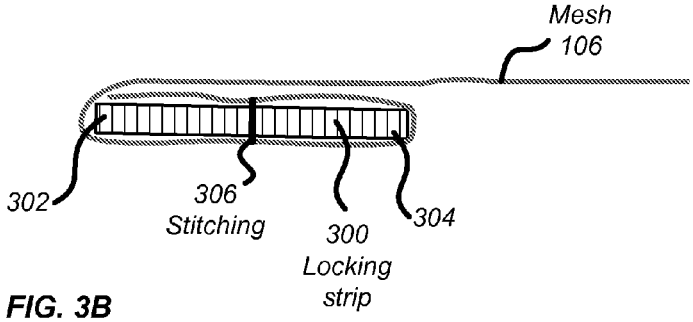
FIG. 3B is a cross section view illustrating the locking strip of FIG. 3A attached to the mesh.
Figure 3C:
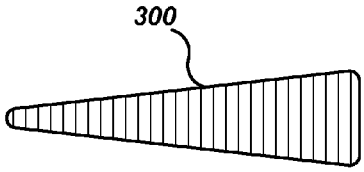
FIG. 3C illustrates a cross section for an alternative embodiment of the locking strip of FIGS. 3A and 3B.

FIG. 3B is a cross section view illustrating the locking strip 300 of FIG. 3A attached to the mesh 106. In FIG. 3B, the locking strip 300 is attached to the mesh 106 using stitching 306. The stitching 306 may be applied using an industrial grade sewing machine configured for sewing fabric and mesh to plastic materials. Two layers of the mesh may be stitched to the locking strip 300 and the mesh 106 may folded over the top of the locking strip 300. While two layers of the mesh 106 are illustrated as attached to the locking strip 300 more or fewer layers of the fabric of the mesh 106 may be stitched to the locking strip. The cross-section of the locking strip 300 is illustrated as rectangular, however various embodiments of the locking strip 300 include triangular, five sided, six sided, cross-sections, and/or the like. FIG. 3C illustrates an example of cross section for an alternative embodiment of the locking strip of FIGS. 3A and 3B. FIG. 3C illustrates a triangular cross-section of locking strip 300. The locking strip 300 of FIG. 3C differs from the locking strip 300 of FIGS. 3A and 3B in that the locking strip 300 of FIG. 3C has a triangular cross section instead of a rectangular cross section.

Figure 4:
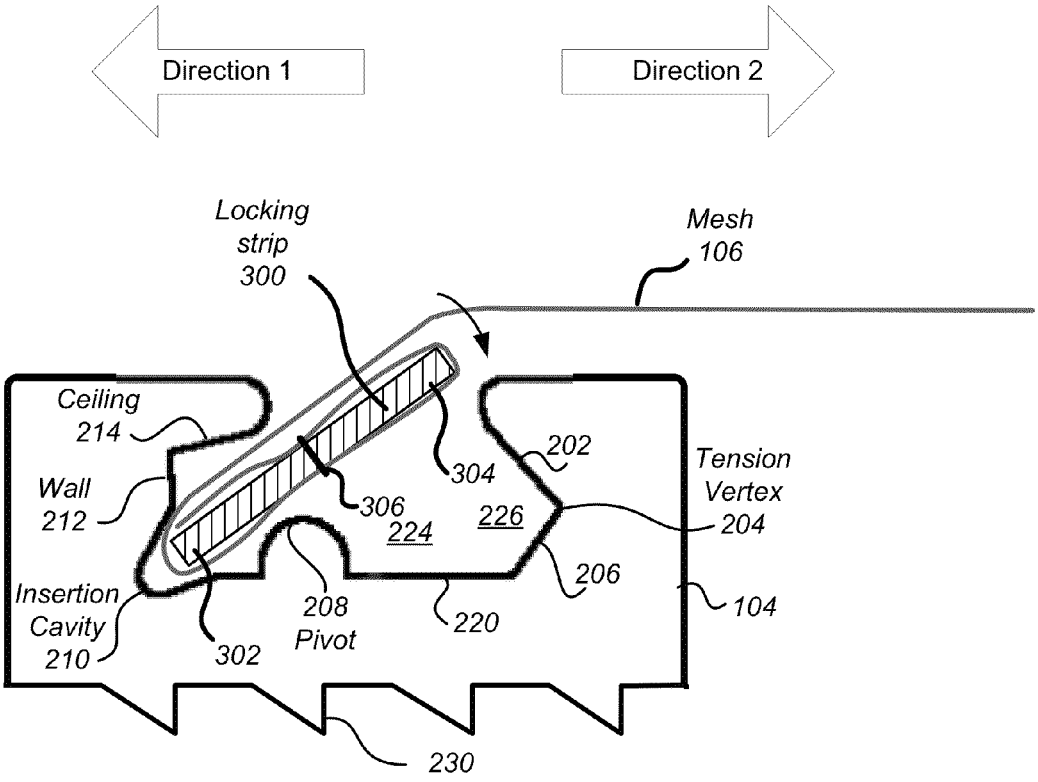
FIGS. 4-7 illustrate insertion of the mesh and locking strip into the locking strip groove 200 of frame member 104.

FIGS. 4-7 illustrate insertion of the mesh 106 and locking strip 300 into the locking strip groove 200 of frame member 104. The frame member 104 is used for illustration in these figures, however, the mesh 106 and locking strip 300 may be inserted into the locking strip groove 200 of frame member 112 in a manner similar to the illustrations of FIGS. 4-7. Referring to FIG. 4, the locking strip 300 and mesh 106 may be inserted through the entrance 222 into the insertion cavity 210. For example, a thumb or finger may be used to push on the trailing edge 304. The leading edge 302 of the locking strip 300 may apply force to the mesh 106 generally in the direction 1 to push the mesh 106 into the locking strip groove 200 and into the insertion cavity 210. The insertion cavity 210 is configured to receive the leading edge 302 of the locking strip 300. The insertion cavity 210 is further configured to provide sufficient distance for the trailing edge 304 of the locking strip to clear the second edge 218 and to rotate into the locking strip groove 200.

Figure 5:
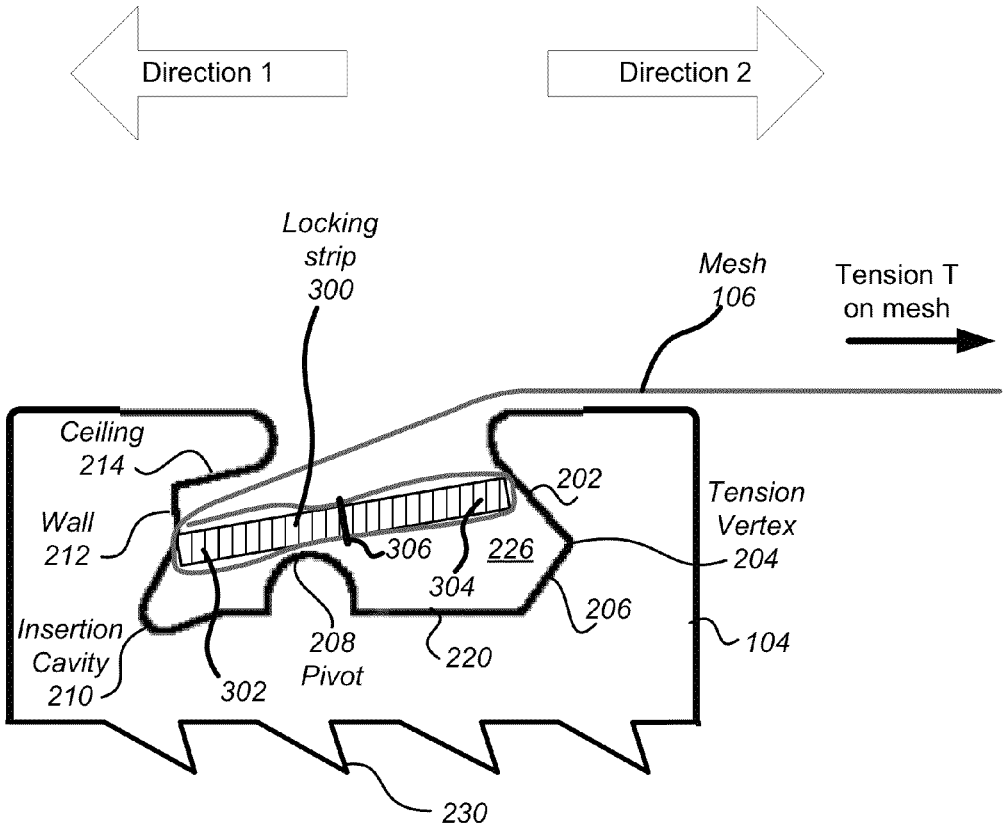

FIG. 5 illustrates pivoting of the locking strip 300 about the pivot 208. When the trailing edge 304 clears the second edge 218, it can be pivoted into the locking strip groove 200. This pivoting action results in the trailing edge 304 of the locking strip 300 to move downward along upper vertex surface 202 into the side cavity 226. The leading edge 302 of the locking strip 300 simultaneously moves upward and away from the deepest portion of the insertion cavity 210. A portion of the locking strip 300 between the leading edge 302 and the trailing edge 304 bears on the pivot 208. A force downward on the trailing edge 304 causes the locking strip to pivot about the pivot 208 and the leading edge 302 to move out of the insertion cavity 210. The downward force on the trailing edge 304 may be applied manually by a user, for example using a thumb or finger. As the locking strip 300 pivots, it also moves in direction 2 deeper into the side cavity 226. In some embodiments, the trailing edge 304 of the locking strip 300 snaps past the second edge 218 as it is rotated or pivoted into the locking strip groove 200.

A tension T is a force on the mesh in direction 2. Once the locking strip trailing edge has rotated past the second edge 218, the tension T may be applied to the mesh 106 to further urge the locking strip 300 to pivot into position in the locking strip groove 200. It will be appreciated by persons having ordinary skill in the art that tension T may be applied to the mesh 106 by applying a force to the frame member 104 in direction 1 and/or by applying a force to the mesh 106 in direction 2. As the locking strip 300 further pivots, the trailing edge 304 may slide along upper vertex surface 202 in general downward in direction 2 while the leading edge 302 moves up along an upper surface of the insertion cavity until it is at about the wall 212.

Figure 6:
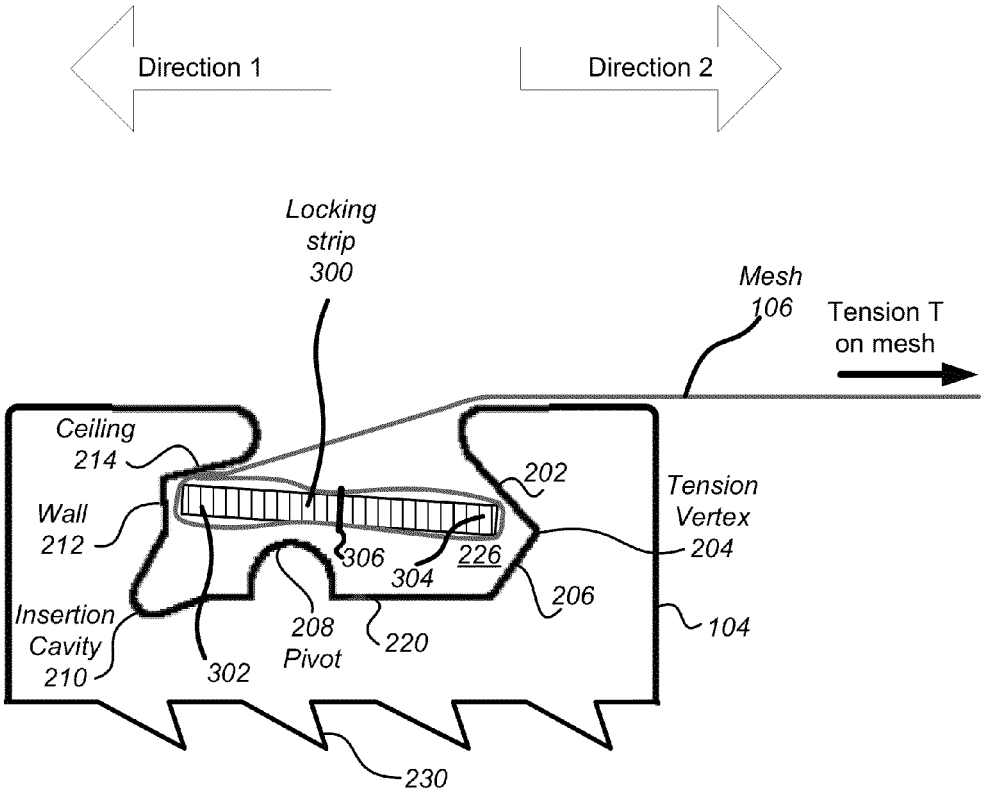

Referring to FIG. 6, the tension T may slide the leading edge 302 up the wall 212 until it reaches the ceiling 214. The leading edge 302, in its uppermost position, bears against ceiling 214. The tension T on the mesh 106 may pull the leading edge 302 of the locking strip 300 along the ceiling 214 as the trailing edge 304 continues to slide downward along the upper vertex surface 202 and into the side cavity 226. The tension T on the mesh 106 also pivots the locking strip 300 about the pivot 208 to rotate the trailing edge 304 into the vertex 204. The lower vertex surface 206 tends to constrain the trailing edge 304 against the vertex 204.

Figure 7:
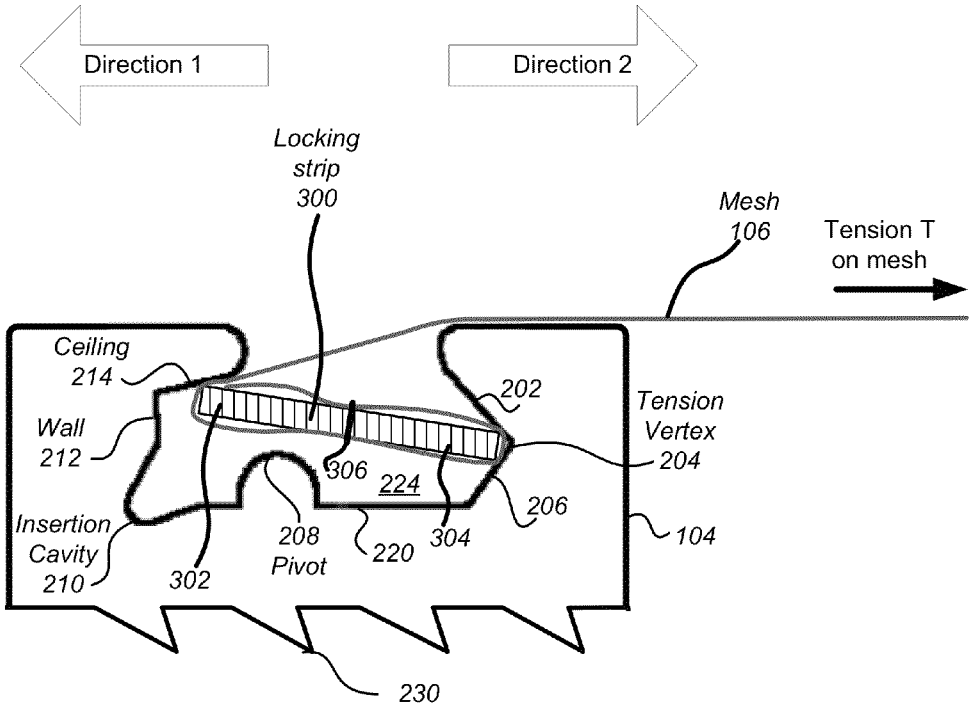

Referring to FIG. 7, the locking strip 300 is illustrated in the locked position in the locking strip groove 200. Increasing the tension T forces the trailing edge 304 of the locking strip 300 to slide upward along lower vertex surface 206 and/or downward against upper vertex surface 202, urging the trailing edge 304 into the vertex 204. The trailing edge 304 tends to pinch the fabric of the mesh 106 against the upper vertex surface 202 and the lower vertex surface 206. The increased tension T may also lift the locking strip 300 up off the pivot 208 against the ceiling 214. The leading edge 302 also tends to pinch the fabric of the mesh 106 against ceiling 214.

As illustrated in FIG. 7, when the width of the locking strip 300 (the distance between the leading edge 302 to the trailing edge 304) is greater than the distance between vertex 204 and the first edge 216 the leading edge 302 of locking strip 300 can not pivot past the first edge 216 and exit the groove. This prevents the mesh 106 and/or the locking strip 300 from being pulled out while manipulating the frame member 104 and/or the mesh 106.

The tension T on the mesh 106 will generally lock the mesh in position as shown in FIG. 7 resulting in the mesh being pinched or jammed between the leading edge 302 and ceiling 214 in the insertion cavity 210. The tension T also results in the mesh 106 being jammed or pinched between the trailing edge 304 and the vertex 204 in the side cavity 226. The jamming or pinching of the mesh 106 by the locking strip 300 against ceiling 214 and vertex 204 (upper vertex surface 202 and lower vertex surface 206) prevents the mesh from slipping out of the locking strip groove 200. This pinching of the mesh 106 against the various surfaces of the locking strip groove 200 relieves force on the stitching 306. Thus, the stitching 306 serves to secure the mesh 106 to the locking strip 300 while manipulating the locking strip 300 and inserting it into the locking strip groove 200. A novel feature is that most of the forces on the mesh 106 resulting from the tension T are applied between the mesh 106 and the locking strip 300 rather than directly between the mesh 106 and a surface of the frame member 104. Flexibility of the locking strip permits distribution of the forces over a larger area and reduces tearing of the mesh.

In some embodiments, the lower vertex surface 206 forms an angle with respect to a floor 220 of between about 90 and 175 degrees. In some embodiments, the upper vertex surface 202 forms an angle with the lower vertex surface 206 of between about 20 and 170 degrees. In various embodiments, the angle between the lower vertex surface 206 and the upper vertex surface 202 is about 5, 10, 20, 30, 40, 50, 60, 70, 80, 90 100, 110, 120, 130, 140, 150, 160, or 170 degrees. In various embodiments, an angle between the wall 212 and the ceiling 214 is about 5, 10, 20, 30, 40, 50, 60, 70, 80, or 90. In some embodiments, the wall 212 and the ceiling 214 form an acute angle of between about 20 and 90 degrees.

Optionally, a knifepoint groove 228 (illustrated in FIG. 2B) may be used for removing the mesh 106 after use of the silkscreen frame 100 and/or 110. When the mesh 106 is under tension, it may be difficult to release the tension for removing the frame member 104 from the base 102. A blade or pointed object may be slid longitudinally along the knifepoint groove 228 to cut and/or tear the mesh 106 to release tension for removal.

Figure 8:
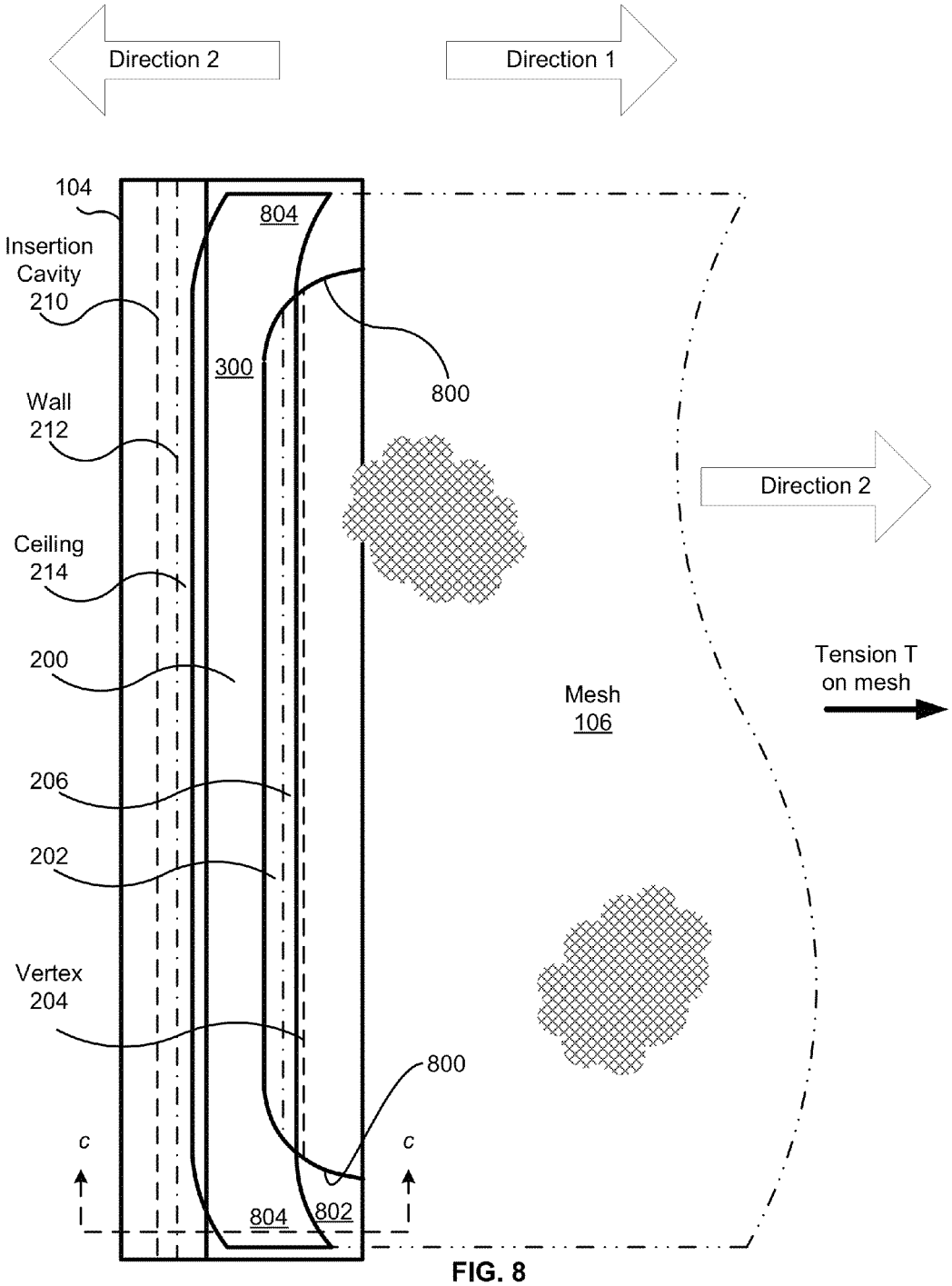
FIG. 8 is a top plan view illustrating the locking strip in the locked position in the locking strip groove.

FIG. 8 is a top plan view illustrating the locking strip 300 in the locked position in the locking strip groove 200. The vertex 204 provides a repeatable position for the trailing edge 304 of the locking strip 300 when locked. Under tension T, the trailing edge 304 tends to slide into the vertex 204 all along the longitudinal length or long axis of the locking strip 300. Thus, the locking position of the trailing edge 304 in the vertex 204 may be repeated uniformly along the longitudinal length of the locking strip 300. This repeatable positioning may reduce slippage of the mesh 106 along the long axis of the locking strip 300 and enhance uniform tension T on the mesh 106 along the long axis of the locking strip 300. However, in some embodiments, the tension T may initially be non-uniform along the longitudinal axis of the locking strip resulting in a region of increased localized tension. This localized tension may be released by pressing down on the leading edge 302 at a selected release point near the increased localized tension. The point at which leading edge 302 is pressed down allows localized slippage of the mesh. The amount of the localized slippage is very small such that repeatedly pressing on a point can provide controlled adjustment of the tension on the mesh 106 in that point.

The upper vertex surface 202, vertex 204, and/or lower vertex surface 206 may be removed at an end of the frame member 104 and/or 112. Line 800 is a vertical surface seen from edge on and illustrates a limit of removal the upper vertex surface 202, vertex 204, and/or lower vertex surface 206. (see FIG. 9). Region 802 illustrates a region at the end of the frame member 104 where the upper vertex surface 202, vertex 204, and/or lower vertex surface 206 have been removed. No support for resisting tension T may be provided to the locking strip 300 in the region 802. As a result, the locking strip 300 may bend at the ends in the direction of the tension, thus relieving stress on the mesh 106 at the corners. FIG. 8 illustrates a deflected portions 804 of the ends of the locking strip deflecting into a region adjacent the surface 800 and above the region 802. This is sometimes referred to as "softening the corners." In FIG. 8, the deflected portions 804 at the ends of the locking strip 300 are exaggerated. An actual bend in the deflected portions 804 may not be perceptible. The insertion cavity 210, the wall 212, the ceiling 214, the upper vertex surface 202, the lower vertex surface 206, and the vertex 204 are represented in dotted line to show that they are hidden from view inside the locking strip groove 200. The locking strip 300 is shown in solid line even though portions are interior to the locking strip groove 200 for clarity, to illustrate its shape.

Figure 9:
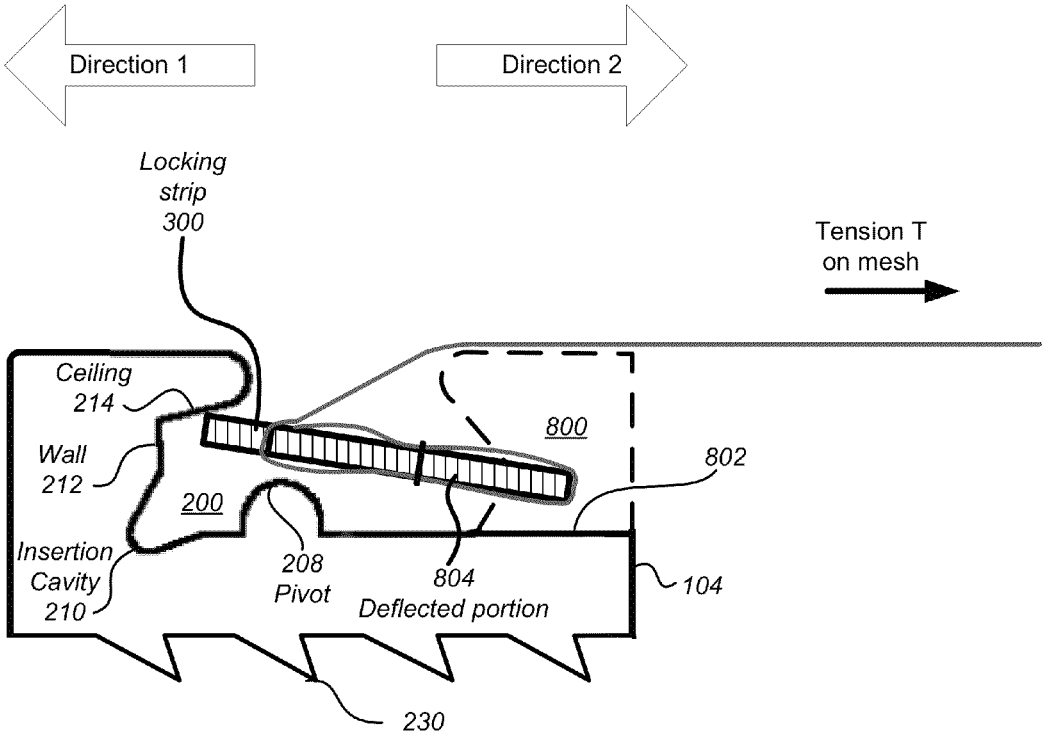
FIG. 9 is a cross section view of a frame member taken along line c-c of FIG. 8.

FIG. 9 is a cross section view of the frame member 104 taken along line c-c of FIG. 8. The surface 800 is represented by a dotted line indicating that the surface 800 is not a part of the cross section but is offset from the cross section. Region 802 is seen from edge on and is represented as a line. A deflected portion 804 of an end of the locking strip 300 may be seen extending into the region above the region 802 and adjacent the surface 800. In various embodiments, a length of unsupported locking strip 300 (deflected portion 804) is about 0.5, 1, 1.5, 2, 2.5, 3, 3.5, 4, 4.5, or greater than 5 inches. In various embodiments, a length of frame member 104 where an end of the upper vertex surface 202, vertex 204, and/or lower vertex surface 206 have been removed (region 802) is greater than about 0.5, 1, 1.5, 2, 2.5, 3, 3.5, 4, 4.5, or 5 inches.

Figure 10A:
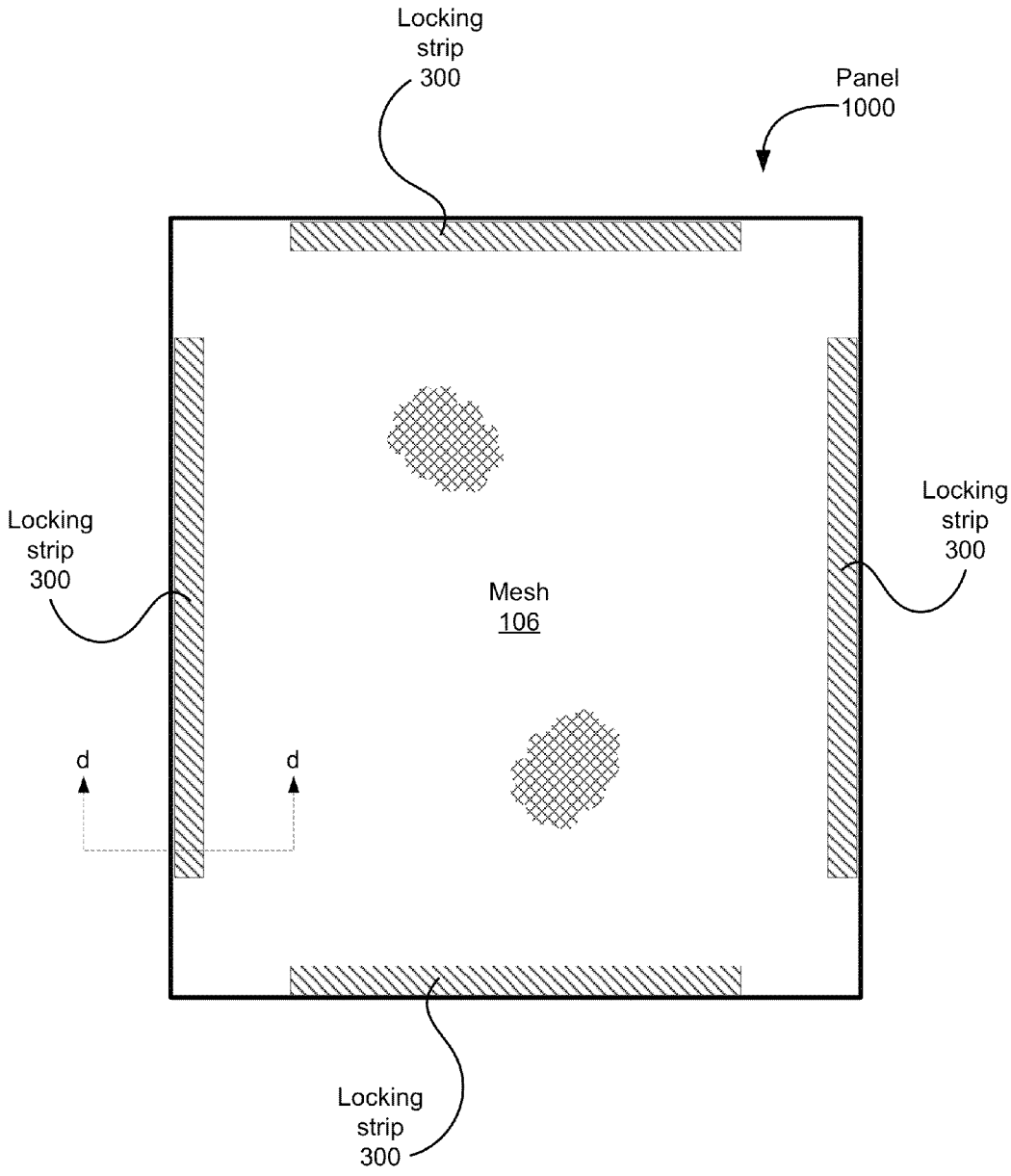
FIGS. 10A-10D illustrates fabrication of a mesh panel with the locking strip for use in the locking strip groove.

FIGS. 10A-10D illustrates fabrication of a mesh panel 1000 with the locking strip 300 for use in the locking strip groove 200. Referring to FIG. 10A the mesh is cut to size. Locking strips 300 are secured to the edges. The panel 1000 includes mesh 106 that may be cut to a predetermined size that has been optimized for a type of mesh and anticipated stretch under an expected tension. The edges of the mesh 106 may be straight. The locking strips 300 may be secured the edges of the mesh 106. Securing the locking strips 300 along the straight edges may simplify manufacturing. In some embodiments, an emulsion is applied to a surface of the mesh 106 before securing the locking strips 300 to the mesh 106.

Figure 10B:
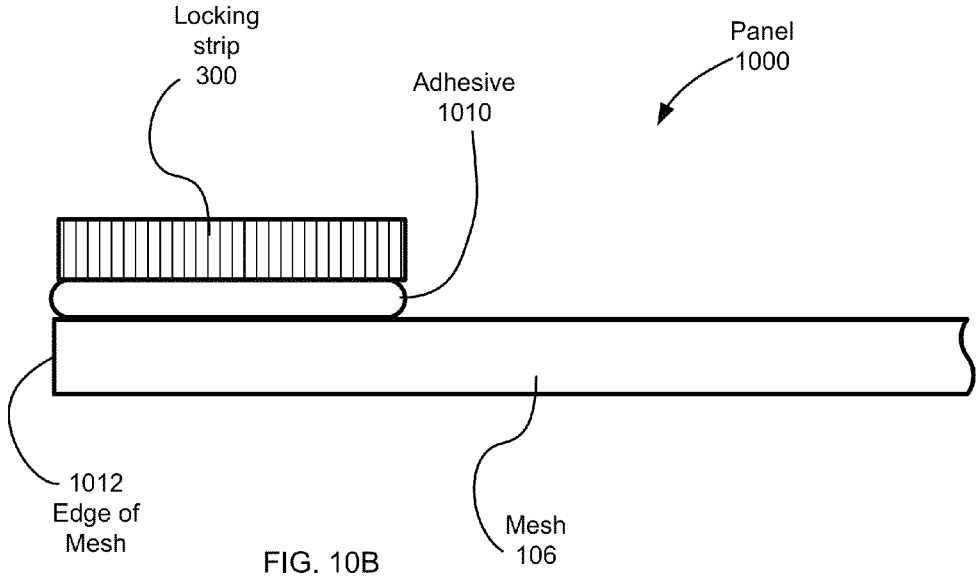

The locking may be mechanically secured to the edges of the mesh (e.g., by holding, pinning, clamping, tacking, etc.). Optionally, the locking strips 300 are attached to the mesh 106 using an adhesive. FIG. 10B is a cross section view of the locking strip 300 and a portion of the mesh 106 taken along line d-d of FIG. 10A. An adhesive 1010 may be placed along the edge of the mesh 106 and the locking strip 300 is placed on the adhesive 1010. In various embodiments, the adhesive includes glue, contact adhesive, single sided tape, double sided tape, tacking material, and/or the like. In some embodiments, the adhesive may be applied to the locking strip. The adhesive 1010 may be configured to bond to the locking strip 300 upon contact. For example, an adhesive such as contact cement may be applied to both the locking strip 300 and the mesh 106 to secure the locking strip 300 on contact with the mesh 106. A strip of plastic film (not illustrated) may cover the adhesive 1010 to prevent it from unintentionally sticking to surfaces during handling of the panel 1000. Upon mounting the locking strip 300, the plastic film may be pealed off to expose the adhesive 1010 and the locking strip 300 may be placed in contact with the adhesive 1010 to attach it to the mesh 106. Optionally, an emulsion (not illustrated) is applied to a surface of the mesh 106.

Figure 10C:
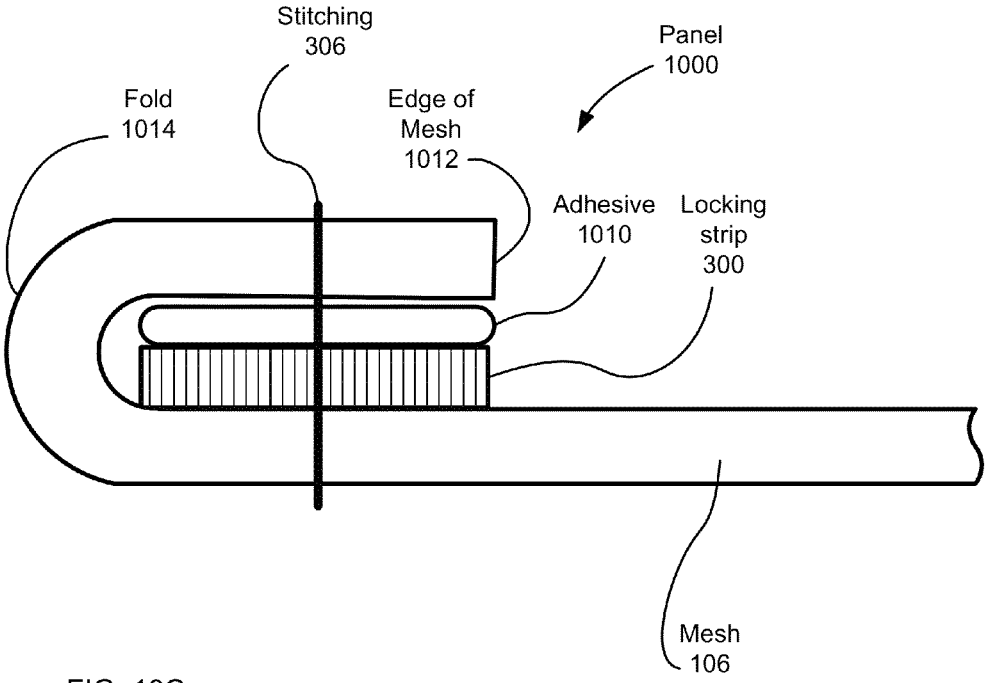
Figure 10D:
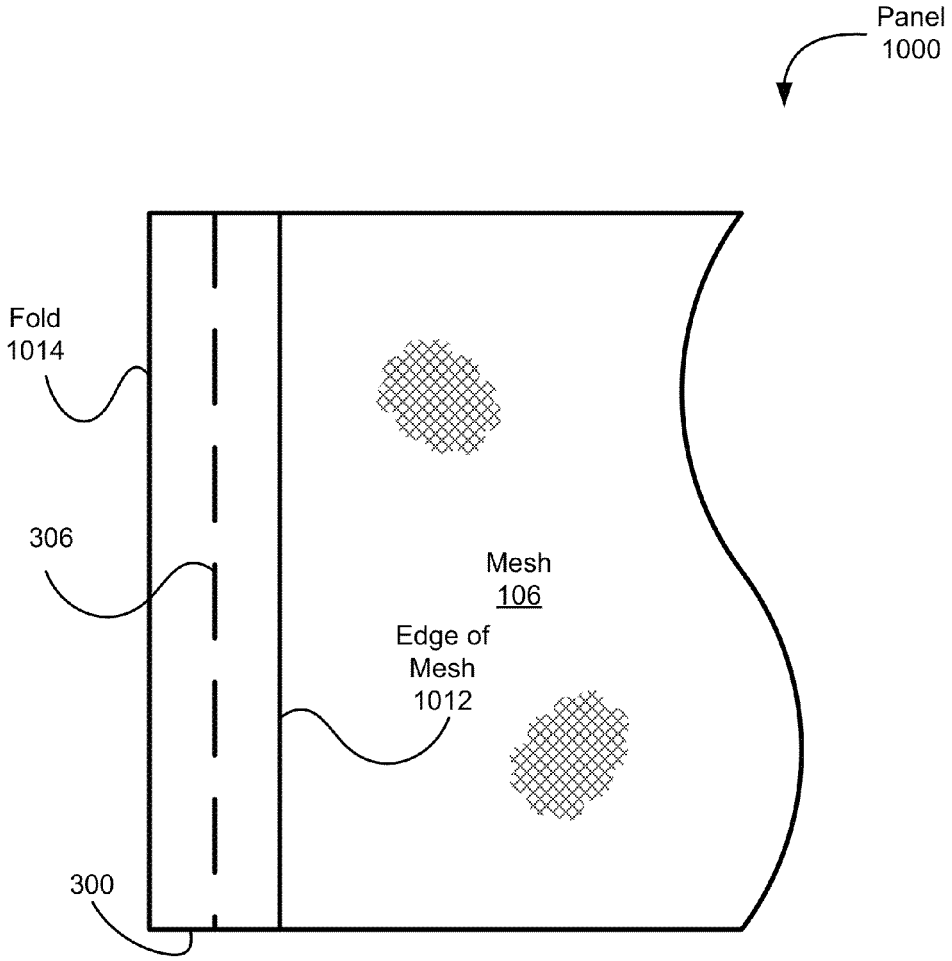

Referring to FIG. 10C, an end of the mesh 1012 may be folded (fold 1014) around the locking strip 300. Stitching 306 may be applied along the length of the locking strip 300. The process may be repeated for locking strips along each edge of a rectangular mesh 106 to fabricate the panel 1000. FIG. 10D is a plan view of a portion of a locking strip and folded mesh showing the stitching 306 along a length of the locking strip 300.

While the adhesive is illustrated as being between the mesh 106 and the locking strip 300, a person having ordinary skill in the art will appreciate that an adhesive, e.g. tape, may be applied to the distal side of the mesh 106 and bond to the locking strip 300 through the mesh 106. Emulsion may be applied to the top and/or bottom side of the mesh 106 (not illustrated). Further, multiple layers of emulsion may be applied to a surface of the mesh 106. While four locking strips 300 are illustrated in FIG. 10A, a person having ordinary skill in the art will appreciate that fewer than four or more than four locking strips 300 may be attached to the silkscreen panel 1000. While the adhesive 1010 is illustrated as being about the same width as the locking strip 300, the adhesive 1010 may be wider or narrower than the locking strip 300. For example, a width of adhesive 1010 two times a width of the locking strip 300 may be applied to an edge of the mesh 106. Thus, when the mesh 106 is folded, the adhesive 1010 adheres to both sides of the locking strip 300.

The adhesive may be used instead of the stitching 306 to keep the locking strip 300 attached to the mesh 106 during insertion of the locking strip 300 into the locking strip groove 200. The tension is supported by the mechanical forces between the locking strip 300 and the locking strip groove 200 rather than the adhesive. Thus, a relatively weak adhesive may be used to attach the locking strips 300. A decrease in strength of the adhesive 1010 in bonding to emulsion may have little or no effect on insertion of the locking strip 300 into the locking strip groove 200. Thus, a wide range of adhesive bonding strengths may be used. The wide range of adhesive strengths permits consideration of adhesives that are easier and safer to use and are more compatible with the environment when cleaning up the materials after use. Moreover, degradation of the adhesive 1010 after the locking strip 300 is in position and tension has been applied to the mesh 106 may not effect the tension or use of the silkscreen panel 1000.

Figure 11:
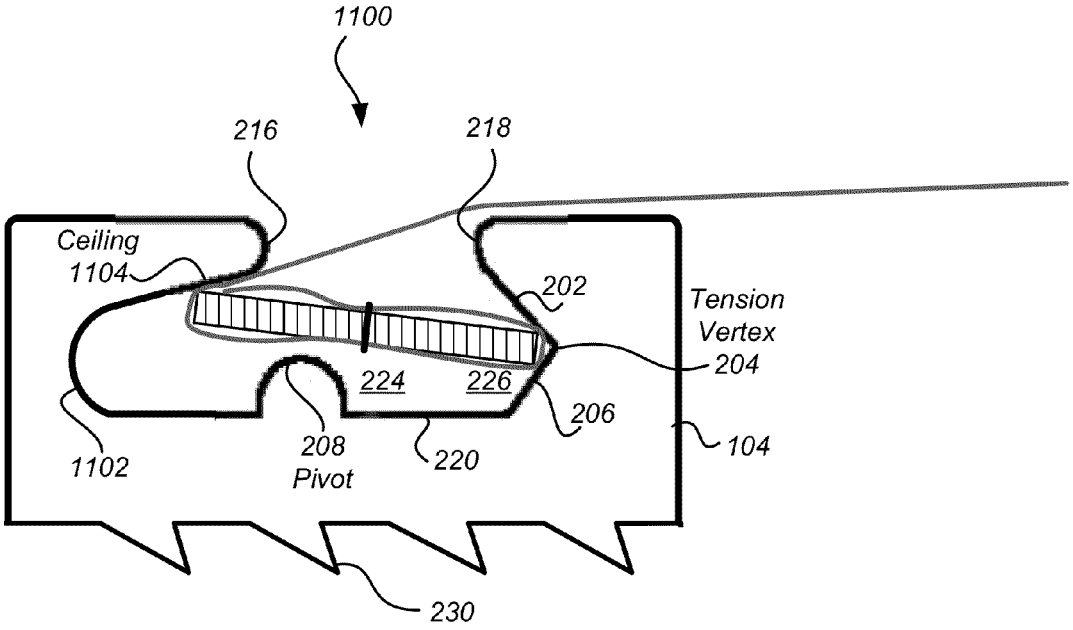
FIG. 11 illustrates an alternative embodiment of a groove disposed in the frame member 104.

FIG. 11 illustrates an alternative embodiment of a groove 1100 disposed in the frame member 104. FIG. 11 differs from FIG. 4-7 in that an insertion cavity 1102 does not include the wall 212. FIG. 11 further differs in that the insertion cavity 1102 is larger and extends further from the first edge 216, and a ceiling 1104 is longer than ceiling 214. As with FIGS. 2-7, the pivot 208 is optional.

The embodiments discussed herein are illustrative. As these embodiments are described with reference to illustrations, various modifications or adaptations of the methods and/or specific structures described may become apparent to persons of ordinary skill in the art. All such modifications, adaptations, or variations that rely upon the teachings of the embodiments, and through which these teachings have advanced the art, are considered to be within the spirit and scope of the present application. Hence, these descriptions and drawings should not be considered in a limiting sense, as it is understood that the present application is in no way limited to only the embodiments illustrated.

The invention claimed is:

1. A screen-printing panel for mounting on a frame, the panel comprising:

a rectangular mesh having four substantially straight edges, each edge of the printing panel comprising:

a semi-rigid, flexible locking strip disposed along the edge of the printing panel, the mesh folded around an edge of the locking strip to dispose the folded mesh adjacent two surfaces of the locking strip; and a length of stitching sewn through the locking strip along a longitudinal axis of the locking strip and through two opposing surfaces of the mesh adjacent the locking strip, the stitching configured to secure the mesh to the locking strip during insertion of the locking strip into a locking strip groove of a frame and during application of tension to the printing panel, the semi-rigidity of the locking strip configured to retain the respective edge of the printing panel within the locking strip groove while the printing panel is under tension.

2. The screen-printing panel of claim 1, further comprising an adhesive configured to secure the mesh to the locking strip during sewing and during folding of the mesh around the edge of the locking strip before sewing.

3. The screen-printing panel of claim 2, wherein the adhesive is disposed on two sides of a length of tape, one side of the length of tape secured to the locking strip, the other side of the length of tape secured to the mesh.

4. The screen-printing panel of claim 1, wherein the locking strip is configured to flex along the longitudinal axis of the locking strip during insertion of the edge of the locking strip into a locking strip groove of a frame.

5. The screen-printing panel of claim 1, wherein the stitching includes an upper stitching penetrating the locking strip and securing the mesh to a first surface of the locking strip and a lower stitching securing the mesh to a second surface of the locking strip.

6. The screen-printing panel of claim 1, wherein a length of the edge of the printing panel is greater than a length of the locking strip.

7. The screen-printing panel of claim 1, wherein the locking strip is a semi-rigid, flexible plastic.

8. The screen-printing panel of claim 7, wherein a cross section of the locking strip is rectangular.

9. The screen-printing panel of claim 7, wherein a cross section of the locking strip is triangular.

10. The screen-printing panel of claim 9, wherein the fold of the mesh around the locking strip is around a wide edge of the triangular cross section.

11. The screen-printing panel of claim 1 made by:

cutting a mesh into a rectangular panel having four substantially straight edges and for each edge:

disposing a semi-rigid flexible locking strip along the edge of the mesh;

folding the edge of the mesh around an edge of the locking strip to position the a first and second portion of the mesh adjacent a first and second surface, respectively, of the locking strip; and sewing the mesh to the first and second surfaces of the locking strip using stitching, the stitching sewn through the first portion of the mesh, the locking strip, and the second portion of the mesh.

12. A screen-printing system comprising:

a rectangular mesh having four substantially straight edges, each edge of the printing panel comprising:

a semi-rigid, flexible locking strip disposed along the edge of the printing panel, the mesh folded around an edge of the locking strip to dispose the folded mesh adjacent two surfaces of the locking strip, and a length of stitching sewn through the locking strip along a longitudinal axis of the locking strip and through two opposing surfaces of the mesh adjacent the locking strip, the stitching configured to secure the mesh to the locking strip during insertion of the locking strip into a locking strip groove of a frame and during application of tension to the printing panel, the semi-rigidity of the locking strip configured to retain the respective edge of the printing panel within the locking strip groove while the printing panel is under tension; and a rectangular frame, the screen-printing panel secured to the rectangular frame under tension.

13. The screen-printing system of claim 11, further comprising a rectangular frame having four sides, each side including a locking strip groove disposed along a length of the side, each locking strip securing the mesh against the tension within a respective locking strip groove.

14. A method for making a screen-printing panel, the method comprising:

cutting a mesh into a rectangular panel having four substantially straight edges and for each edge:

disposing a semi-rigid flexible locking strip along the edge of the mesh;

folding the edge of the mesh around an edge of the locking strip to position the a first and second portion of the mesh adjacent a first and second surface, respectively, of the locking strip; and sewing the mesh to the first and second surfaces of the locking strip using stitching, the stitching sewn through the first portion of the mesh, the locking strip, and the second portion of the mesh.

15. The method of claim 14 further comprising:

applying an adhesive to a first surface of the locking strip; and attaching the first surface of the locking strip to a first portion of the mesh along an edge of the panel using the adhesive.

16. The method of claim 15 wherein the adhesive is disposed along at least one side of a length of tape.

17. The method of claim 15 wherein the adhesive is disposed on the mesh.

18. The method of claim 14 wherein the locking strip cross section is rectangular.

19. The method of claim 14, wherein the locking strip cross section is triangular.

20. The method of claim 14, wherein the screen printing panel includes a frame, the locking strips of the screen printing panel securing the frame to the screen printing panel by:

inserting each locking strip of the screen printing panel through an entrance along the top of a locking strip groove disposed along a respective side of a rectangular frame used for screen printing;

securing each inserted locking strip within the respective locking strip groove; and applying tension to the mesh of the screen printing panel.

* * * * *